US010319292B2

(12) United States Patent
Wang et al.

(10) Patent No.: US 10,319,292 B2
(45) Date of Patent: Jun. 11, 2019

(54) DRIVING SYSTEM FOR A DISPLAY DEVICE, AND DRIVING CIRCUIT APPLICABLE TO OLED

(71) Applicant: Shenzhen China Star Optoelectronics Technology Co., Ltd., Shenzhen (CN)

(72) Inventors: Zhenling Wang, Shenzhen (CN); Tai Jiun Hwang, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/897,696

(22) PCT Filed: Oct. 10, 2015

(86) PCT No.: PCT/CN2015/091673

§ 371 (c)(1),
(2) Date: Dec. 27, 2017

(87) PCT Pub. No.: WO2017/045235

PCT Pub. Date: Mar. 23, 2017

(65) Prior Publication Data

US 2018/0158401 A1 Jun. 7, 2018

(30) Foreign Application Priority Data

Sep. 15, 2015 (CN) ..... 2015 1 0583321

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2310/027* (2013.01);
(Continued)

(58) Field of Classification Search
CPC ..... G09G 3/3225; G09G 3/3233; G09G 3/32; G09G 2320/0673; G09G 2320/0238;
(Continued)

(56) References Cited

U.S. PATENT DOCUMENTS 8,982,017 B2 3/2015 Lee et al.
2007/0091029 A1* 4/2007 Uchino ..... G09G 3/3233 345/76

(Continued)

FOREIGN PATENT DOCUMENTS

CN 103247278 A 8/2013
CN 103310730 A 9/2013

(Continued)

OTHER PUBLICATIONS

Notification of Transmittal of the International Search Report and the Written Opinion of the International Searching Authority (Forms PCT/ISA/220, PCT/ISA/237, and PCT/ISA/210) dated May 27, 2016, by the State Intellectual Property Office of People's Republic of China in corresponding International Application No. PCT/CN2015/091673. (12 pages).

*Primary Examiner* — Amit Chatly

(57) ABSTRACT

Provided is a driving system for a display device and a driving circuit applicable to an OLED, which belong to the field of display technology, and can eliminate the phenomenon of shortening in lifetime of the OLED caused by a long-term DC bias light-emitting state of the OLED.

6 Claims, 2 Drawing Sheets

(52) U.S. Cl.
CPC ..... *G09G 2310/0251* (2013.01); *G09G 2320/0204* (2013.01); *G09G 2320/0233* (2013.01); *G09G 2320/0238* (2013.01); *G09G 2320/045* (2013.01); *G09G 2320/0673* (2013.01)

(58) Field of Classification Search
CPC ..... G09G 2320/0233; G09G 2310/027; G09G 2320/045
See application file for complete search history.

(56) References Cited

U.S. PATENT DOCUMENTS

| | | | | |
|---|---|---|---|---|
| 2007/0115244 | A1* | 5/2007 | Shin | G09G 3/3266 345/100 |
| 2008/0186301 | A1* | 8/2008 | Park | G09G 3/3233 345/211 |
| 2011/0096061 | A1 | 4/2011 | Lin et al. | |
| 2013/0057532 | A1 | 3/2013 | Lee et al. | |
| 2014/0320473 | A1 | 10/2014 | Ma | |
| 2014/0362130 | A1 | 12/2014 | Duan et al. | |
| 2015/0161934 | A1 | 6/2015 | Chen et al. | |
| 2015/0187262 | A1* | 7/2015 | Eom | G09G 3/3275 345/690 |
| 2016/0343296 | A1 | 11/2016 | Wang et al. | |

FOREIGN PATENT DOCUMENTS

| | | | |
|---|---|---|---|
| CN | 203300188 | U | 11/2013 |
| CN | 103680468 | A | 3/2014 |
| CN | 104464618 | A | 3/2015 |

* cited by examiner

DRIVING SYSTEM FOR A DISPLAY DEVICE, AND DRIVING CIRCUIT APPLICABLE TO OLED

CROSS-REFERENCE TO RELATED APPLICATIONS

The present application claims the priority of Chinese patent application CN 201510583321.3, entitled "A driving system for a display device, and a driving circuit applicable to OLED" and filed on Sep. 15, 2015, the entirety of which is incorporated herein by reference.

FIELD OF THE INVENTION

The present disclosure relates to the field of display technologies, and in particular, to a driving system for a display device, and a driving circuit applicable to an OLED.

BACKGROUND OF THE INVENTION

In the prior art, during a display procedure of an organic light-emitting diode (OLED for short) display device, an electric field of a long-time loaded DC driving voltage causes polarization of OLED internal ions, and formation of a built-in electric field, which increases an OLED threshold voltage, greatly reduces luminous efficiency of the OLED, and shortens lifetime of the OLED.

As shown in FIG. 1, an existing 2T1C pixel unit driving circuit includes an input transistor $T_1$, a storage capacitor $C_S$, and a driving transistor $T_2$. In FIG. 1, $T_1$ and $T_2$ are n-type transistors; $V_{SCAN}$ and $V_{DATA}$ are respectively a scan voltage and a data voltage; $T_2$ is used to drive the OLED; and $V_{DD}$ and $V_{SS}$ are respectively a high level and a low level.

During operation of the 2T1C pixel unit driving circuit as shown in FIG. 1, when $V_{SCAN}$ is at a high level, data voltage $V_{DATA}$ is applied to $T_2$ through $T_1$, to activate $T_2$. At this time, an anode of the OLED has a potential of ($V_{DATA}$-$V_{th}$-$V_{OLED}$), wherein $V_{th}$ is a threshold voltage of $T_2$, and $V_{OLED}$ is a voltage difference between the anode and a cathode of the OLED. When $V_{SCAN}$ is at a low level, a voltage stored in $C_S$ can still activate $T_2$.

It can be seen from the above, the 2T1C pixel unit driving circuit as shown in FIG. 1, after being applied with data voltage $V_{DATA}$ through a data line, will be in a light-emitting display state during one whole frame of time. A long-term DC bias light-emitting state of the OLED accelerates polarization of organic materials, thereby enhancing the built-in electric field of the OLED, increasing the OLED threshold voltage, remarkably reducing the luminous efficiency of the OLED, and shortening the lifetime of the OLED.

SUMMARY OF THE INVENTION

It is an object of the present disclosure to provide a driving system for a display device, and a driving circuit applicable to an OLED, thereby eliminating a phenomenon of shortening in lifetime of the OLED caused by a long-term DC bias light-emitting state of the OLED.

According to a first aspect of the present disclosure, a driving circuit applicable to an OLED is provided, which includes a driving unit connected to a scan line and a data line for driving the OLED, and a reverse bias unit connected to the OLED, wherein the reverse bias unit is used for controlling reverse bias of the OLED when a black picture is inserted between two image frames.

Optionally, the driving unit includes a first transistor, a second transistor, and a storage capacitor. An output terminal of the first transistor is connected to a first terminal of the storage capacitor and a control terminal of the second transistor; a second terminal of the storage capacitor is connected to a first driving signal; and an output terminal of the second transistor is connected to an anode of the OLED, a cathode of which is connected to a cathode driving signal.

Optionally, the cathode driving signal is switched between a first level and a second level. The first level is equal to a high level of the first driving signal, and higher than the second level.

Optionally, the reverse bias unit includes a third transistor and a fourth transistor. The third transistor has a control terminal, an input terminal, and an output terminal respectively connected to a first control signal, a second terminal of the storage capacitor, and an input terminal of the second transistor. The fourth transistor has a control terminal, an input terminal, and an output terminal respectively connected to a second control signal, the anode of the OLED, and a second driving signal. The second driving signal has an amplitude lower than that of the first driving signal, but higher than that of a signal connected to the control terminal of the second transistor.

The second transistor and the OLED are reversely biased when the third transistor and the fourth transistor are respectively deactivated and activated, and the cathode driving signal is at the second level.

The present disclosure brings about the following beneficial effects. In the embodiment of the present disclosure, the reverse bias unit controls the reverse bias of the OLED when the black picture is inserted between two frames, thereby not only eliminating the residual electric charge in the OLED, to extend the lifetime of the OLED, but also ensuring that the OLED reverse bias does not affect the display effect of the display device.

According to a second aspect of the present disclosure, a driving system of a display device is provided, which comprises the above driving circuit, and further comprises:

a processing unit, which caches a data signal from a signal source, performs frame multiplication on the data signal by insertion of a black picture between two adjacent data signal frames, and outputs a frame multiplied data signal to a display panel; and a control unit, which outputs a reverse bias signal when the processing unit outputs a data signal corresponding to the black picture, wherein the reverse bias unit of the driving circuit is configured to control reverse bias of the OLED and a driving transistor according to the reverse bias signal.

Optionally, the reverse bias signal comprises a first control signal and a second control signal. The first control signal is supplied to a control terminal of a third transistor in the reverse bias unit, and the second control signal is supplied to a control terminal of a fourth transistor.

Optionally, the first control signal and the second control signal have a same frequency and opposite phases.

Optionally, the reverse bias signal further comprises a cathode driving signal which is switched between a first level and a second level, the first level being higher than the second level. The cathode driving signal is at a high level when the processing unit outputs the data signal corresponding to the black picture.

Optionally, the driving system further comprises:

an analysis unit, which analyzes an average image level frame-by-frame; and a gamma voltage unit, which outputs a first gamma voltage when the average image level output from the analysis unit is higher than a preset value, or otherwise, outputs a second gamma voltage which is higher than the first gamma voltage.

Other features and advantages of the present disclosure will be set forth in the description which follows and, in part, will be obvious from the description, or may be learned by practice of the present disclosure. The objectives and other advantages of the present disclosure may be realized and attained by the structure particularly pointed out in the description, claims and drawings.

BRIEF DESCRIPTION OF THE DRAWINGS

In order to explicitly illustrate the technical solution of the embodiments of the present disclosure, the embodiments will be described in combination with accompanying drawings, in which.

DETAILED DESCRIPTION OF THE EMBODIMENTS

The present disclosure will be explained in detail with reference to the embodiments and the accompanying drawings, whereby it can be fully understood how to solve the technical problem by the technical means according to the present disclosure and achieve the technical effects thereof, and thus the technical solution according to the present disclosure can be implemented. It is important to note that as long as there is no structural conflict, all the technical features mentioned in all the embodiments may be combined together in any manner, and the technical solutions obtained therefrom all fall within the scope of the present disclosure.

Example 1

Figure 2:
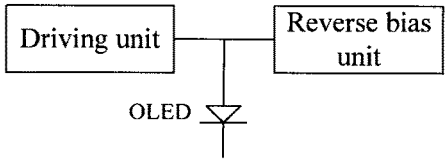
FIG. 2 is a schematic structural view of a driving circuit according to an embodiment of the present disclosure.

A driving circuit applicable to an OLED is provided in an embodiment of the present disclosure. As shown in FIG. 2, the driving circuit includes a driving unit connected to a scan line and a data line for driving the OLED, and a reverse bias unit connected to the OLED.

In the prior art, the OLED is always in a DC bias light-emitting state. That is, a potential of an anode of the OLED is higher than that of a cathode thereof. This easily enhances a built-in electric field of the OLED and increases an OLED threshold voltage, thereby greatly reducing the luminous efficiency and shortening the lifetime of the OLED.

In order to eliminate the built-in electric field of the OLED, it is necessary to reverse-bias the OLED. However, if the OLED is in a reverse bias state, it will not emit light smoothly. Thus an entire display device will enter a black screen state. Therefore, in the embodiment of the present disclosure, the reverse bias unit controls reverse-bias of the OLED when a black picture is inserted between two image frames, thereby ensuring that the reverse-bias of the OLED does not affect the display effect of the display device.

Figure 3:
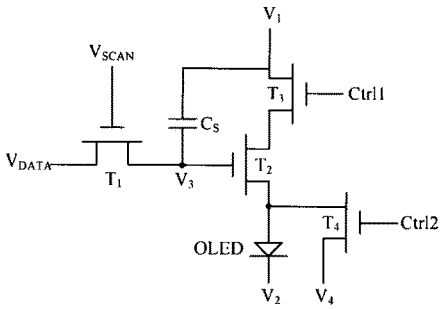
FIG. 3 is a specific diagram of a driving circuit in an embodiment of the present disclosure.

Specifically, as shown in FIG. 3, the driving unit includes a first transistor $T_1$, a second transistor $T_2$, and a storage capacitor $C_S$. An output terminal of the first transistor $T_1$ is connected to a first terminal of the storage capacitor $C_S$ and a control terminal of the second transistor $T_2$. A second terminal of the storage capacitor $C_S$ is connected to a first driving signal $V_1$, and an output terminal of the second transistor $T_2$ is connected to the anode of the OLED, the cathode of which is connected to a cathode driving signal $V_2$.

And the reverse bias unit includes a third transistor $T_3$ and a fourth transistor $T_4$, wherein the third transistor $T_3$ has a control terminal, an input terminal, and an output terminal respectively connected to a first control signal Ctrl1, a second terminal of the storage capacitor $C_S$, and an input terminal of the second transistor $T_2$; and the fourth transistor $T_4$ has a control terminal, an input terminal, and an output terminal respectively connected to a second control signal Ctrl2, the anode of the OLED and, a second driving signal $V_2$.

Further, an amplitude of the second driving signal $V_2$ is smaller than that of the first driving signal $V_1$ and greater than that of a signal connected to the control terminal of the second transistor $T_2$.

It should be noted that a high level of the first driving signal $V_1$ in FIG. 3 is equal to a high level $V_{DD}$ in the prior art. And the cathode driving signal $V_2$ is switched between a first level and a second level, wherein the first level is higher than the second level. Specifically, a volt value of the first level is equal to that of the high level $V_{DD}$ in the prior art, and a volt value of the second level is equal to a low level $V_{SS}$ in the prior art.

In the embodiment of the present disclosure, the first control signal Ctrl1 and the second control signal Ctrl2 are respectively used to drive the third transistor $T_3$ and the fourth transistor $T_4$. The third transistor $T_3$ is provided so as to disconnect the input terminal of the second transistor $T_2$ from the first driving signal $V_1$, and the fourth transistor $T_4$ is provided to allow the OLED to be in a reverse bias state when the third transistor $T_3$ disconnects the input terminal of the second transistor $T_2$ from the first driving signal $V_1$. When the third transistor $T_3$ connects the input terminal of the second transistor $T_2$ to the first driving signal $V_1$, the fourth transistor $T_4$ must be disconnected from the OLED, or otherwise the OLED will not emit light normally, thus affecting the display effect of the display device.

Figure 6:
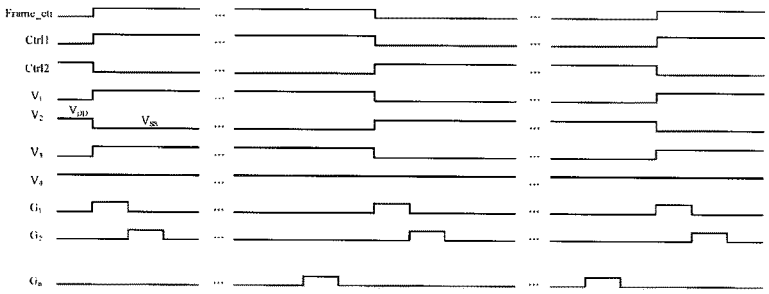
FIG. 6 is a signal diagram in an embodiment of the present disclosure.

Since the third transistor $T_3$ and the fourth transistor 14 are in a state in which one of them is turned off and the other is turned on, the first control signal Ctrl1 and the second control signal Ctrl2 respectively driving the third transistor $T_3$ and the fourth transistor $T_4$ should be of a same frequency, but in opposite phases, as shown in FIG. 6.

Figure 1:
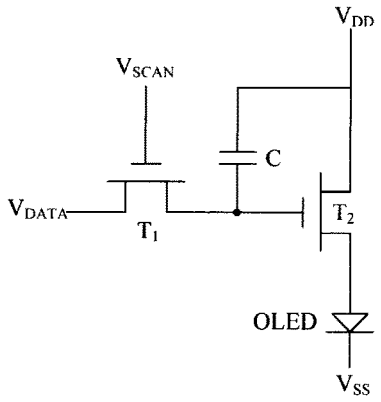
Fig. 1 Prior Art
FIG. 1 is a schematic structural view of an existing driving circuit.

Specifically, when the first control signal Ctrl1 and the second control signal Ctrl2 are respectively at a high level and a low level, the third transistor $T_3$ is turned on and the fourth transistor 14 is turned off. And at this time, the cathode driving signal $V_2$ is at a low level, so that the display device can display a normal picture. In this case, the driving circuit shown in FIG. 3 has an equivalent circuit as shown in FIG. 1.

Figure 4:
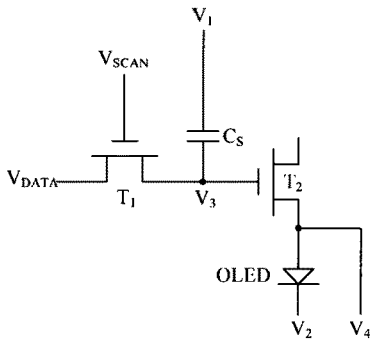
FIG. 4 is an equivalent diagram of FIG. 3.

When the first control signal Ctrl1 and the second control signal Ctrl2 are respectively at the low level and the high level, the third transistor $T_3$ and the fourth transistor $T_4$ are respectively turned off and turned on. And at this time, the cathode driving signal $V_2$ is at a high level. Obviously, the equivalent circuit of FIG. 3 at this moment is shown in FIG. 4. Since the third transistor $T_3$ is turned off, and the level of the cathode driving signal $V_2$ is higher than that of the second driving signal $V_4$, which is at the same time higher than a voltage $V_3$ of the control terminal of the second transistor $T_2$, the OLED does not emit light and is in a reverse bias state together with the second transistor $T_2$. This can cancel residual charge in the second transistor $T_2$ and the OLED, thereby suppressing shift of a threshold voltage in the second transistor $T_2$, and meanwhile extending lifetime of the OLED.

Example 2

Figure 5:
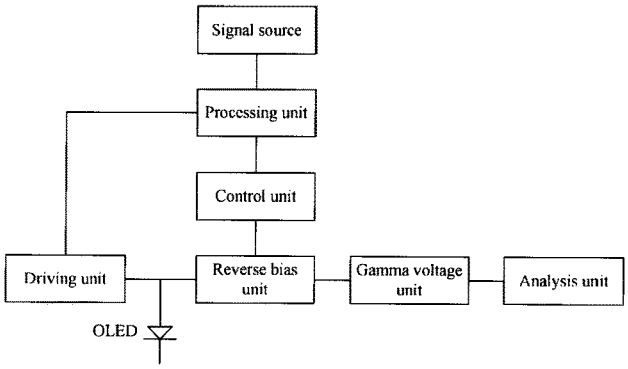
FIG. 5 is a schematic structural view of a driving system according to an embodiment of the present disclosure.

The present embodiment provides a driving system of a display device, which includes, as shown in FIG. 5, a driving circuit as shown in FIG. 2, and further comprises:

a processing unit, which buffers a data signal from a signal source, performs frame multiplication on the data signal by insertion of a black picture between adjacent two data signal frames, and outputs frame multiplied data signal to a display panel.

The principle of frequency multiplication technology is to add a black picture frame between two conventional image frames, so as to increase a refresh rate of an ordinary display device from 60 Hz up to 120 Hz, and increase a display signal thereof from previous 60 frames per second up to now 120 frames per second, thus effectively solving the problems such as image blurring and smearing generated during play of motion pictures by the display device. This is favorable for clearing an image blur from a previous frame to improve a dynamic clarity effect, and for reducing image smearing to a degree that are difficult for human eyes are to perceive.

Specifically, the processing unit comprises a single frame memory module and a dual frame memory module. When the display device starts to work, the signal source outputs a first frame picture signal, and the processing unit receives the first frame picture signal and stores it in the single frame memory module. When the signal source outputs a second frame picture signal, the processing unit receives a second frame picture signal and stores it in the dual frame memory module. The single frame memory module and the dual frame memory module output picture signals in turn.

The processing unit also includes a black picture generating module for generating a black picture signal.

As shown in FIG. 5, the driving system further includes a control unit for outputting a control signal, which controls output of a picture signal or a black picture by a signal processor, and outputs a reverse bias signal when the control unit outputs a data signal corresponding to the black picture.

Further, the reverse bias unit in the driving circuit is used for controlling the reverse bias of the OLED and the driving transistor in accordance with the reverse bias signal.

In order to drive the reverse bias unit, the reverse bias signal includes a first control signal and a second control signal, which are respectively supplied to the control terminal of the third transistor and the control terminal of the fourth transistor in the reverse bias unit. In addition, the reverse bias signal further comprises a cathode driving signal which is switched between a first level and a second level, the first level being higher than the second level. When the processing unit outputs a data signal corresponding to the black picture, the cathode driving signal will be at a high level.

Specifically, as shown in FIG. 6, when the control unit outputs a control signal Frame_ctrl at the high level, the processing unit will output the picture signal; the first control signal Ctrl1 and the second control signal Ctrl2 will be respectively at the high level and the low level; the first driving signal $V_1$ will be at the high level; the cathode driving signal $V_2$ will be equal to $V_{SS}$; $V_3$ will be at the high level; and the second driving signal $V_4$ will be a constant value. Gate lines from $G_1$ to $G_n$ of the display device will then start scanning line by line, to display pictures output by the processing unit on the display device.

When the control unit outputs the control signal Frame_ctrl at the low level, the processing unit will output the black picture signal; the first control signal Ctrl1 and the second control signal Ctrl2 will be respectively at the low level and the high level; the first driving signal $V_1$ will be at the low level; the cathode driving signal $V_2$ will be equal to $V_{DD}$; $V_3$ will be at the low level; and the second driving signal $V_4$ will be a constant value. The gate lines from $G_1$ to $G_n$ of the display device will then start scanning line by line, to display the black picture output by the processing unit on the display device. The second transistor $T_2$ and the OLED in the driving circuit will enter a reverse bias state.

Further, since the frame multiplication procedure is realized by insertion of the black frame in the present embodiment, there is a possibility that the picture brightness will be lowered. In order to ensure a proper brightness and a satisfactory display effect of the display device, as shown in FIG. 5, the driving module provided in the present embodiment further comprises an analysis unit and a gamma voltage unit. Therein, the analysis unit is configured to analyze an average picture level (APL) on a frame-by-frame basis; and the gamma voltage unit will output a first gamma voltage when the APL output by the analysis unit is higher than a preset value (e.g., 0.3), or otherwise, output a second gamma voltage, the first gamma voltage being lower than the second gamma voltage.

Although the embodiments of the present disclosure have been described above, the description is merely for the purpose of facilitating the understanding of the present disclosure and is not intended to limit the present disclosure. It should be understood by those skilled in the art that various changes in form and details may be made therein without departing from the spirit and scope of the present disclosure. It is intended that the scope of protection of the disclosure should be determined within the scope of the claims appended hereto.

The invention claimed is:

1. A driving circuit applicable to an OLED, which includes a driving unit connected to a scan line and a data line for driving the OLED, and a reverse bias unit connected to the OLED, wherein the reverse bias unit is used for controlling reverse bias of the OLED when a black picture is inserted between two image frames;

wherein the driving unit includes a first transistor, a second transistor, and a storage capacitor, wherein an output terminal of the first transistor is connected to a first terminal of the storage capacitor and a control terminal of the second transistor; wherein a second terminal of the storage capacitor is connected to a first driving signal; and wherein an output terminal of the second transistor is connected to an anode of the OLED, a cathode of which is connected to a cathode driving signal; and wherein the reverse bias unit includes a third transistor and a fourth transistor, wherein the third transistor has a control terminal, an input terminal, and an output terminal respectively connected to a first control signal, a second terminal of the storage capacitor, and an input terminal of the second transistor, wherein the fourth transistor has a control terminal, an input terminal, and an output terminal respectively connected to a second control signal, the anode of the OLED, and a second driving signal, wherein the second driving signal has an amplitude lower than that of the first driving signal, but higher than that of a signal connected to the control terminal of the second transistor, and wherein the second transistor and the OLED are reversely biased when the third transistor and the fourth transistor are respectively deactivated and activated, and the cathode driving signal is at the first level.

2. The driving circuit according to claim 1, wherein the cathode driving signal is switched between a first level and a second level, wherein the first level is equal to a high level of the first driving signal, and higher than the second level.

3. A driving system of a display device, the driving system comprising a driving circuit, which includes a driving unit connected to a scan line and a data line for driving the OLED, and a reverse bias unit connected to the OLED, wherein the reverse bias unit is used for controlling reverse bias of the OLED when a black picture is inserted between two image frames; and the driving system further comprising:

a processing unit, which caches a data signal from a signal source, performs frame multiplication on the data signal by insertion of a black picture between two adjacent data signal frames, and outputs a frame multiplied data signal to a display panel; and a control unit, which outputs a reverse bias signal when the processing unit outputs a data signal corresponding to the black picture, wherein the reverse bias unit of the driving circuit is configured to control reverse bias of the OLED and a transistor of the driving unit according to the reverse bias signal;

wherein the driving unit includes a first transistor, a second transistor, and a storage capacitor, wherein an output terminal of the first transistor is connected to a first terminal of the storage capacitor and a control terminal of the second transistor; wherein a second terminal of the storage capacitor is connected to a first driving signal; and wherein an output terminal of the second transistor is connected to an anode of the OLED, a cathode of which is connected to a cathode driving signal; and wherein the reverse bias unit includes a third transistor and a fourth transistor, wherein the third transistor has a control terminal, an input terminal, and an output terminal respectively connected to a first control signal, a second terminal of the storage capacitor, and an input terminal of the second transistor, wherein the fourth transistor has a control terminal, an input terminal, and an output terminal respectively connected to a second control signal, the anode of the OLED, and a second driving signal, wherein the second driving signal has an amplitude lower than that of the first driving signal, but higher than that of a signal connected to the control terminal of the second transistor, and wherein the second transistor and the OLED are reversely biased when the third transistor and the fourth transistor are respectively deactivated and activated, and the cathode driving signal is at the first level.

4. The driving system according to claim 3, wherein the first control signal and the second control signal have a same frequency and opposite phases.

5. The driving system according to claim 3, wherein the cathode driving signal is switched between a first level and a second level, the first level being higher than the second level; and wherein the cathode driving signal is at a high level when the processing unit outputs the data signal corresponding to the black picture.

6. The driving system according to claim 3, further comprising:

an analysis unit, which analyzes an average image level frame-by-frame; and a gamma voltage unit, which outputs a first gamma voltage when the average image level output from the analysis unit is higher than a preset value, or otherwise, outputs a second gamma voltage which is higher than the first gamma voltage.

* * * * *